US010096252B2

(12) United States Patent
Ren et al.

(10) Patent No.: US 10,096,252 B2
(45) Date of Patent: Oct. 9, 2018

(54) METHODS AND SYSTEMS FOR PERFORMANCE BASED ARRIVAL AND SEQUENCING AND SPACING

(71) Applicant: General Electric Company, Schenectady, NY (US)

(72) Inventors: Liling Ren, Niskayuna, NY (US); Harold Woodruff Tomlinson, Niskayuna, NY (US); Vincent Paul Staudinger, Niskayuna, NY (US); Jeffrey Russell Bult, Grand Rapids, MI (US); Mauricio Castillo-Effen, Rexford, NY (US); Szabolcs Andras Borgyos, Grand Rapids, MI (US); Stephen Koszalka, Kent, WA (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 85 days.

(21) Appl. No.: 15/196,741

(22) Filed: Jun. 29, 2016

(65) Prior Publication Data

US 2018/0005532 A1 Jan. 4, 2018

(51) Int. Cl.

*G08G 5/04* (2006.01)
*G08G 5/00* (2006.01)
*G08G 5/02* (2006.01)

(52) U.S. Cl.

CPC ..... *G08G 5/0043* (2013.01); *G08G 5/0013* (2013.01); *G08G 5/0026* (2013.01);
(Continued)

(58) Field of Classification Search

CPC ..... G01C 23/00; G01C 23/005; G01C 21/00; G01C 21/20; G08G 5/0021; G08G 5/0039;
(Continued)

(56) References Cited

U.S. PATENT DOCUMENTS 6,393,358 B1 5/2002 Erzberger et al.
6,463,383 B1 10/2002 Baiada et al.
(Continued)

FOREIGN PATENT DOCUMENTS

EP 1 497 808 B1 3/2006
EP 2 927 893 A2 10/2015

OTHER PUBLICATIONS

Lowther, Marcus B. et al., "En Route Speed Change Optimization for Spacing Continuous Descent Arrivals", AIAA Guidance, Navigation and Control Conference and Exhibit, AIAA 2008-7404, Aug. 18-21, 2008, 19pgs.
(Continued)

*Primary Examiner* — Dalena Tran
(74) *Attorney, Agent, or Firm* — GE Global Patent Operation; Nittin Joshi

(57) ABSTRACT

A method, medium, and system to receive flight parameter data relating to a plurality of flights, the flight parameter data including indications of aircraft performance based navigation (PBN) capabilities, flight plan information, an aircraft configuration, and an airport configuration for the plurality of flights; assign probabilistic properties to the flight parameter data; receive accurate and current position and predicted flight plan information for a plurality of aircraft corresponding to the flight parameter data; determine a probabilistic trajectory for two of the plurality of aircraft based on a combination of the probabilistic properties of the flight parameter data and the position and predicted flight plan information, the probabilistic trajectory being specific to the two aircraft and including a target spacing specification to maintain a predetermined spacing between the two aircraft at a target location with a specified probability; and generate a record of the probabilistic trajectory for the two aircraft.

20 Claims, 5 Drawing Sheets

(52) U.S. Cl.
CPC ..... *G08G 5/0034* (2013.01); *G08G 5/0082* (2013.01); *G08G 5/025* (2013.01)

(58) Field of Classification Search
CPC .... G08G 5/0013; G08G 5/0091; G08G 5/025; G08G 5/003; G08G 5/0095; G08G 5/0082; G08G 5/0078; B64D 2045/0085; B64D 45/00; G05D 1/101; G05D 1/0044; G05D 1/0005
USPC .... 701/120, 3, 121, 301, 400, 465; 340/961, 340/977–979; 342/29, 36
See application file for complete search history.

(56) References Cited

U.S. PATENT DOCUMENTS

| | | | | |
|---|---|---|---|---|
| 6,584,400 | B2 | 6/2003 | Beardsworth | |
| 6,912,461 | B2 | 6/2005 | Poreda | |
| 6,950,037 | B1 | 9/2005 | Clavier et al. | |
| 7,248,963 | B2 | 7/2007 | Baiada et al. | |
| 8,150,588 | B2 | 4/2012 | Klooster | |
| 8,207,867 | B2 | 6/2012 | Ghalebsaz Jeddi | |
| 8,290,696 | B1 | 10/2012 | Sridhar et al. | |
| 8,655,506 | B2 | 2/2014 | Gomez et al. | |
| 8,818,696 | B2 | 8/2014 | Klooster et al. | |
| 8,942,914 | B2 * | 1/2015 | Subbu ..... | G08G 5/0013 701/120 |
| 8,983,760 | B2 | 3/2015 | Mcdonald | |
| 2009/0125221 | A1 * | 5/2009 | Estkowski ..... | G05D 1/104 701/120 |
| 2012/0209457 | A1 * | 8/2012 | Bushnell ..... | G01C 21/00 701/13 |
| 2013/0110388 | A1 | 5/2013 | Becher et al. | |
| 2015/0269846 | A1 | 9/2015 | De Prins | |

OTHER PUBLICATIONS

Ren, Liling et al., "Flight-Test Evaluation of the Tool for Analysis of Separation and Throughput", Journal of Aircraft, vol. 45, No. 1, Jan.-Feb. 2008, DOI: 10.2514/1.30198, (pp. 323-332, 10 total pages).
Ren, Liling et al., "Separation Analysis Methodology for Designing Area Navigation Arrival Procedures", Journal of Guidance, Control and Dynamics, vol. 30, No. 5, Sep.-Oct. 2007, DOI: 10.2514/1.27067, (pp. 1319-1330, 12 total pages).
Ren, Liling "Modeling and Managing Separation for Noise Abatement Arrival Procedures", Department of Aeronautics and Astronautics, (pp. 1-186, 186 total pages).
Korn, B., et al., "Curved approaches and airborne spacing for efficient closely spaced parallel runway operations in IMC," Digital Avionics Systems Conference (DASC), 29th IEEE/AIAA , pp. 2.C.4-1-2.C.4-8 (Oct. 3-7, 2010).
Thipphavong, J., et al., "Evaluation of the Terminal Sequencing and Spacing system for Performance-Based Navigation arrivals ," Digital Avionics Systems Conference (DASC), 32nd IEEE/AIAA, pp. 1A2-1-1A2-16 (Oct. 5-10, 2013)
Extended European Search Report and Opinion issued in connection with corresponding EP Application No. 17178180.0 dated Dec. 11, 2017.
Ren, L., Methods and Systems for Probabilistic Spacing Advisory Tool(PSAT), GE Co-Pending U.S. Appl. No. 15/435,653, filed Feb. 17, 2017

* cited by examiner

METHODS AND SYSTEMS FOR PERFORMANCE BASED ARRIVAL AND SEQUENCING AND SPACING

BACKGROUND

The present disclosure relates to air traffic management, in particular, to managing trajectories for a mixed fleet of Performance Based Navigation (PBN) capable aircraft and non-PBN aircraft based on probabilistic properties of trajectory predictions.

In conventional operations, an aircraft's flight may generally follow a path defined by radio navigation beacons. Thus, such flight paths are often not the most direct route to a target since only limited number of radio navigation beacons can be listed and shared by all flights in the airspace. RNAV provide a means for an aircraft to know its location at any given moment of time so it can be navigated from its origin to its destination along a path defined by navigation fixes that are not necessarily coincident with radio navigation beacons, resulting in more consistent and more direct routes. RNP, a technology enabled by satellite based navigation, allows an aircraft to fly a RNAV path, including curved segments, with high precision. This technology allows for the flight path to be precisely planned and further optimized to enhance safety, be more direct and improve efficiency. Coupled with the Vertical Navigation (VNAV) capability provided by the Flight Management System (FMS) on board the aircraft, RNP/RNAV procedures, or PBN procedures, are viewed as the future of flight navigation.

However, one problem with the implementation of the PBN is that there may be multiple flights in an airspace to compete for the same resource(s). Without coordination in advance, air traffic controllers may have to vector aircraft by instructing one or more of specific tactical speed, altitude, and heading commands to the aircraft so that a safe separation between aircraft can be maintained all the times. In a terminal area, this may mean flight path stretches and level flight segments, whose exact occurrence and parameters cannot be predicted in advance. In some instances, the skill of an art by the air traffic controller may be heavily depended on given the uncertainties in arrival time and trajectory. Also, RNP/RNAV arrival and approach procedures, although they may have already been developed for a destination terminal area, are often not cleared for flights that capable of flying these procedures and/or may be vectored off the procedure flight path to address spacing between aircraft. As such, there may be a lower than desired utilization of the airborne capabilities and procedures that have already been deployed and future systems.

Therefore, there exists a desire to provide a system and processes that can generate flight path trajectories based on actual conditions for particular flights using probabilities that is compatible with mixed fleet aircraft having different navigational capabilities.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

The present disclosure relates to managing air traffic to, for example, reduce flight time, delay, along track miles, and fuel burn for a mixed fleet of Performance Based Navigation (PBN) aircraft that are capable of and expected to perform Required Navigation Performance (RNP) Area Navigation (RNAV) approaches and non-PBN aircraft that are expected to perform conventional non-RNAV approaches. In some aspects, target spacing at downstream meter fixes are generated dynamically in real time based on probabilistic properties of trajectory predictions for both PBN and non-PBN aircraft. In some instances, such generated target spacings are used as inputs to one or more optimization processes to generate required time of arrivals (RTAs) for downstream meter fixes to provide the aforementioned reductions in flight time, delay, along track miles, and fuel burn. The RTAs thus generated may be sent to the aircraft in-flight and the flight crew for execution, along with advisories of PBN procedures to be expected. In some instances, this information may be shared with the aircraft operator's ground control personnel and/or air traffic management system and/or personal for situation awareness, traffic coordination, performance monitoring and analysis purposes.

Figure 1:
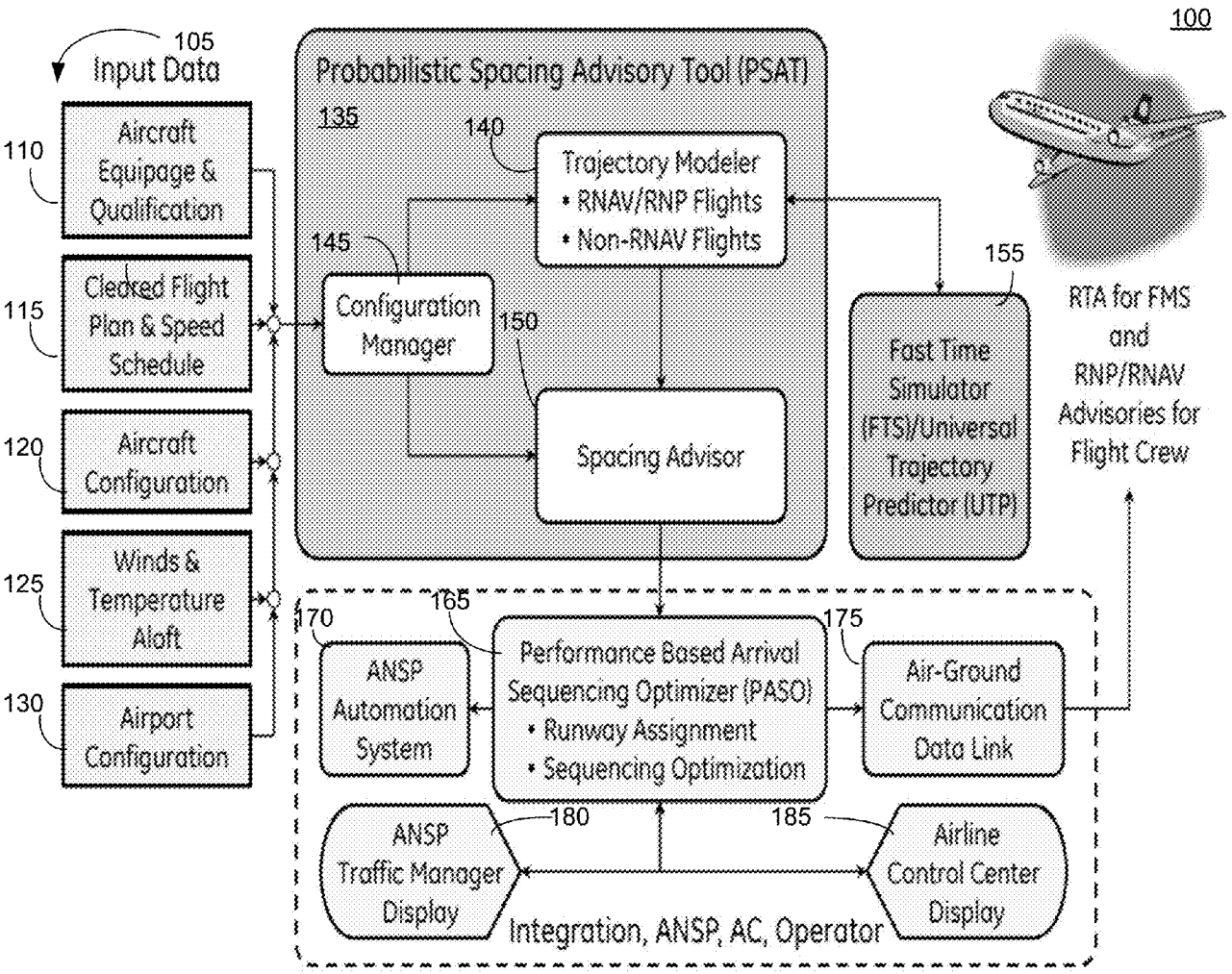
FIG. 1 is an illustrative depiction of a system, in accordance with some embodiments herein.

Referring to FIG. 1, a system 100 is illustrated. System 100 can optimize a sequencing and spacing for a fleet of PBN capable aircraft, as well as non-PBN capable aircraft, into one or more airports in a terminal area. Using the optimization provided by system 100, the probability of successful (uninterrupted or without excessive vectoring) execution of RNP/RNAV approaches for PBN capable aircraft may be increased and the efficiency of approaches for both PBN capable aircraft and non-PBN aircraft may also be (simultaneously) improved. In some regards, the increase in the execution of RNP/RNAV approaches and/or improved efficiencies in approaches may be desired to, for example, reduce flight time, delay, along track miles, fuel burn, noise impact to the community, and emissions. Other benefits and advantages, such as but not limited to, enhanced situational awareness and safety may also be provided or facilitated by system 100.

In an effort to capture and consider the actual factors related to aircraft and airspace related to system 100, a number of input data 105 are provided to system 100. The input data items may be received from external sources, such as from the Air Navigation Service Provider (ANSP) or third party service providers. In some instances, the input data items may be provided to system 100, at least in part, by aircraft to be managed/advised by the system. Input data 105 may include one or more of the specific data items shown in FIG. 1, alone or in combination with each other and other factors, parameters, and values not specifically shown in FIG. 1.

Input data 105 can include data items specifying the aircraft equipage and qualification 110 specifications for the aircraft corresponding to system 100. Input data 105 may be received from a plurality of sources, including aircraft itself, third parties, public and private databases. The aircraft equipage and qualification 110 data will relate to each specific aircraft, including whether the aircraft is PBN capable (e.g., RNAV) or not (e.g., non-RNAV).

Input data 105 may also include data items including a cleared flight plan and speed schedule for each subject aircraft, as indicated at 115. In some instances, this information may represent the best available information and might be incomplete. The aircraft configuration data 120 may include the specific configuration of each aircraft, including actual parameter values such as, for example, engine configuration, payload size, etc. Other factors that may impact an aircraft's performance may also be included in the input data. For example, the weather conditions that will impact a flight's operation such as winds and temperatures aloft may be included in input data 105, as indicated at 125. Other environmental factors may also be included or specified, without any loss of generality herein. Furthermore, aspects of a target area that might impact an aircraft's flight path and/or flight plan can be specified as a terminal airport's configuration 130. The number, length, and orientation of runways, the navigational systems at the airport, the hours of operation, and other considerations may be provided as part of the airport configuration data.

Input data 105 may be provided to a system, device, platform, service, or application that generates a probabilistic spacing for related aircraft. An example of such a system, device, platform, service, or application is shown, in general, at 135 in FIG. 1. In some instances, the system, device, platform, service, or application 135 will be referred to as a probabilistic spacing advisory tool (PSAT). PSAT 135, in the embodiment of FIG. 1, includes a trajectory modeler 140, a configuration manager 145, and a spacing advisor 150. In some aspects, configuration manager 145 sends at least some of the input data 105 relating to the configuration of the aircraft managed by system 100 to trajectory modeler 140 and spacing advisor 150. One or both of the trajectory modeler 140 and spacing advisor 150 may use the provided information in performing their specific tasks.

Trajectory modeler 140 may operate to generate trajectory predictions. The trajectory predications can be specific for each aircraft, taking into account and consideration the different criteria and considerations impacting each aircraft, as represented by the input data 105, as well as the capabilities of each aircraft. For example, the PBN (or non-PBN) capabilities of an aircraft can have a significant effect on the probabilistic trajectory generated by the trajectory modeler. A trajectory for a RNAV/RNP flights may include a precise prescribed flight path since RNAV/RNP aircraft can readily adhere to such flight plans. However, a trajectory for non-RNAV flights may be less precise or explicit since it may be sufficient to provide such flights with a trajectory having some limiting tolerance. In some instances, non-RNAV flight paths may vary within an acceptable tolerance of a prescribe trajectory.

Trajectory modeler 140 may generate a detailed, accurate, and probabilistic trajectory for a particular and specific aircraft based on, at least in part, the configuration of the aircraft as indicated by configuration manager 145 and specific state information related to the particular aircraft. The specific state information related to the particular aircraft may be obtained from a system, device, application, platform, or service 155 by a call, a request, or other fetching function from trajectory modeler 140. System, device, application, platform, or service 155, also referred to herein as a trajectory predictor, may operate to calculate a course for the aircraft to follow given a flight plan and position of the aircraft. In some aspects, trajectory predictor 155 uses flight information and engine information (e.g., engine models) to generate predictions of flight along a lateral path (i.e., trajectory). In some instances, trajectory predictor 155 may be based on a flight management system (FMS) or a similar system, including systems as accurate or even more accurate than a current FMS. In some embodiments, trajectory predictor 155 may be distinct from PSAT 135 and other components of system 100. In some embodiments, trajectory predictor 155 may comprise at least one or more other components, including but not limited to those shown in FIG. 1.

In some aspects herein, the input data of FIG. 1, that is the parameters thereof, are assigned probabilistic properties. Whether the parameters are from external systems, sources, or providers or internally estimated (e.g., to fill-in for noisy or missing data), it is assigned probabilistic properties so that a derived solution herein may be stochastic in nature.

Still referring to FIG. 1, spacing advisor 150 may operate to generate a probabilistic spacing advisory. In some aspects, the probabilistic spacing advisory may comprise a matrix, namely a probabilistic spacing advisory matrix, that provides a listing of a minimum spacing between two specific aircraft for a specific probability of the two aircraft maintaining the requisite separation. As used herein, a required minimum separation between different aircraft may refer to a spacing desired or required by an applicable aircraft operator, airport authority, municipality or entity thereof, and other controlling interests. Each entry in a spacing advisory matrix herein may provide a target (i.e., required or desired) spacing between a pair of flights, for a desired probability at which nominal operations are expected to be executed without excessive (or otherwise unacceptable) vectoring that can tend to impact efficiency.

The spacing advisory matrix output by spacing advisor 150 may be consumed by an Arrival Sequencing Optimizer (ASO) 165 that operates to determine a desired sequence and the spacing to be used between flights going to a destination terminal area. ASO 165 may consider airspace, traffic demand, flight schedule, aircraft operator or ANSP's preferences or requirements in runway usages in the optimization, in differing combinations. An objective of the optimizer may be to minimize a total cost, defined by flight time, delay, fuel burn, emissions, and noise, etc., alone and in combination.

In some instances, the resulting sequence and spacing from ASO 165 is provided in terms of a Required Time of Arrival (RTAs) at corresponding meter fixes for specific individual flights. The sequencing and spacing is provided in terms related to time, with adjustments to flight paths, speeds, trajectories, etc. made with respect to time as well.

In some aspects, RTAs resulting from the processes herein may be verified, validated, and then distributed to ANSP 170 and airline operations 175 control for display 180, 185 and integration into other automation and decision support tools. If deemed valid and reasonable, the RTAs along with the advisories of the expected approach procedures may be sent to the aircraft and the flight crew for implementation.

An ongoing monitoring process may watch the progress of flights to obtain the status of the implementation of the delivered RTAs by the flights, and adjust traffic as necessary.

In some aspects, a feature of the present disclosure is that the probabilistic trajectories determined herein can be determined in real time for the best available information. The trajectories determined herein are for a specific pair of flights, as specified by their respective origin and destination, current state, aircraft type, flight time, latest flight plan and weather (winds and pressure at the minimum) updates, expected approach runway, and other information, alone and in combination. Uncertainty factors that can influence aircraft trajectory four-dimensional (4D) can be evaluated in real-time and can be taken into account in the determination of the target spacing.

In some aspects, target spacing can be provided for each of a plurality of procedure combinations. For example, a flight might be able to land on more than one runway at an airport and a spacing advisory matrix herein may include values for each possibility. That is, multiple entries for the same flight pair may be provided in the spacing advisory matrix. An entry in the spacing advisory matrix may be exampled by "Object Identifier: 0000001, Leading Flight: FDX409, Trailing Flight: ASQ4357, Target Spacing: 131 sec, Leading Aircraft: B752, Leading Destination: MEM, Leading Meter Fix:=HLI, Leading Runway:18C, Leading Procedure Group: MASHH1 RNP18C, Leading Flight Type: RNP, Trailing Aircraft: E145, Trailing Desination: MEM, Trailing Meter Fix: WLDER, Trailing Runway: 18L, Trailing Procedure Group: LTOWN6 ILS18L, Trailing Type: Standard (i.e., non-RNAV)". The spacing matrix may be provided as plain text as shown, or it may be provided, for example, in a markup language such as a XML file.

In some embodiments, the present disclosure provides a mechanism for "related" flight pairs without limiting whether the two flights are coming from same or different directions, going to the same or different runways or even the same or different airports. Related herein means that during a period of time, without limiting its duration or time of occurrence, the two flights may become a concern in terms of spacing within or around the destination terminal area. If the two flights are expected to cross the same metering fix within a small enough time window (from a few seconds to a few minutes), then they are considered related because their spacing over that meter fix may need to satisfy a minimum value for safe and efficient operations. The same is true if the two flights are expected to traverse a small block of airspace (such as a block defined by separation minima, e.g. 3 nautical miles laterally and 1,000 feet vertically) within a small time window. The two flights are related if they are expected to land to the same runway, closely spaced parallel runways, or crossing runways, within a small time window. Of course if any combination of the said conditions is expected, the two flights are related.

Figure 2:
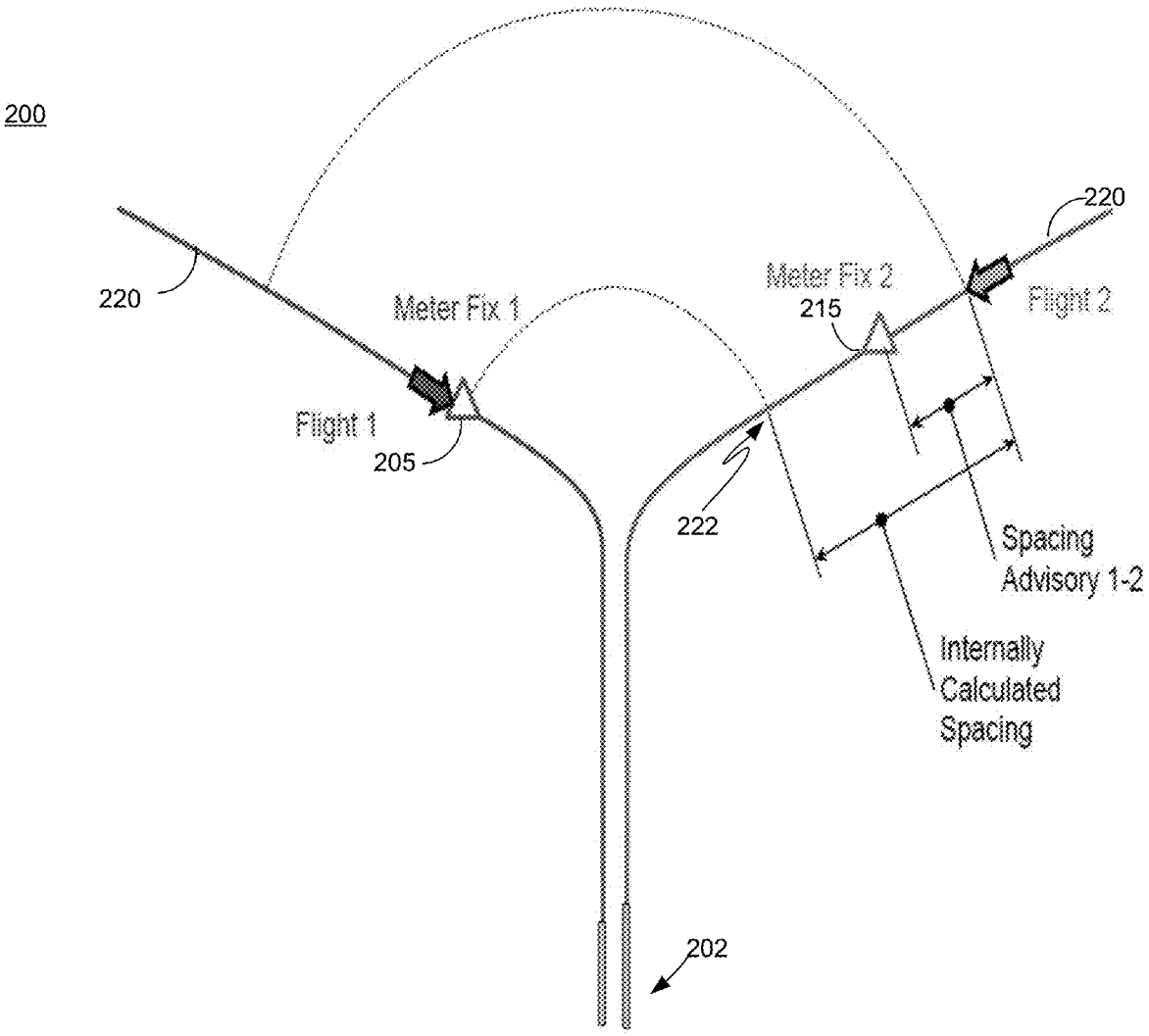
FIG. 2 is an illustrative depictive an airspace, highlighting some aspects of target spacing, in accordance with some embodiments herein.

FIG. 2 is an illustrative depiction of an airspace, in a vicinity of an airport terminal located generally at 202. FIG. 2 is illustrative of two different aircraft on two different flight paths. Here, Flight 1 is shown at a meter fix 1 (205) that is on flight path 210. Flight 2 is shown on fight path 220 approaching meter fix 2 (215). In the present example, Flight 1 is the leading flight and Flight 2 is the trailing flight. Flight 1 and Flight 2 are said to be related flights since they may fly over the same meter fix or other navigation spacing concern to each other in a proximity of a target location, for a period of time without limit to duration or when occurring. The locations of meter fix 1 and meter fix 2 are known, as well as a required minimum spacing for the two aircraft within airspace 200.

The present disclosure provides a mechanism for determining the required spacing at downstream locations of interest (i.e., meter fixes, at terminal airports, etc.). In the present example, a determination may be made regarding the spacing needed at the terminal airport shown at 202 based on upstream meter fixes and the specific aircraft. Here, Flight 1 is at meter fix 1 (205) on flight path 210. A determination is made to project its location onto flight path 220, as shown at 222. The equivalent point on flight path 220 for Flight 1 is calculated in some embodiments herein and is shown at 222. A Spacing Advisor (e.g. 150) herein can determine a required spacing between Flight 1 and Flight 2 so that a minimum separation is maintained until and through the terminal airport area based on the following relationship:

$$RTA2 \geq RTA1 + Spacing\ 12,$$

where RTA1 refers to the time for Flight 1 to arrive at meter fix 1, RTA2 refers to the time for Flight 2 to arrive at meter fix 2, and Spacing 12 refers to the spacing required between Flight 1 and Flight 2. Given the location of meter fix 2 is known and the equivalent point of flight path 220 for Flight 1 at meter fix 1 is calculated, the spacing between Flight 1 and Flight 2 can be calculated by a system herein so that Spacing 12 can be determined. Spacing 12 can be determined and provided as an output from the Spacing Advisor, wherein values are expressed in terms of RTAs. It is noted that the spacing is calculated using probabilities since the RTAs are calculated in advance to the actual completion of the flights to the downstream points of interest (e.g., meter fixes and terminal airports).

Figure 3:
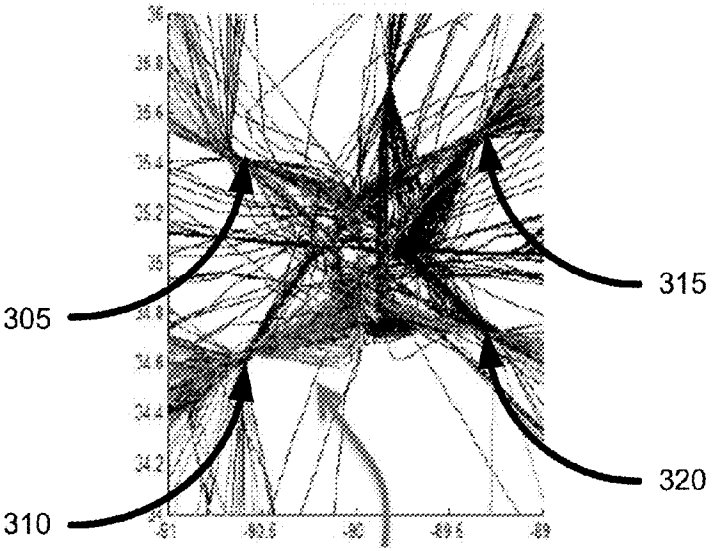
FIG. 3 is a graph illustrating a variability in an airspace near a terminal airport, in accordance with some aspects herein.

FIG. 3 is a graphical presentation of flights in an airspace including a number of meter fixes and a terminal airport. The flight paths are represented by the many different lines and correspond to historical flight information for individual flights. In FIG. 3, the terminal airport is located in the center of the graph. Accordingly, the center vicinity of FIG. 3 is seen as being an intersection of different flight paths. Also, the meter fixes 305, 310, 315, and 320 show the intersecting of a number of flight paths, corresponding to RNAV flights and sometimes non-RNAV flights (e.g., those flights that have a wide spread in trajectory, as shown in FIG. 3). Other flights, not corresponding to the meter fixes, may correspond to non-RNAV flights, including flights vectored away from the meter fixes by an air traffic controller.

Figure 4:
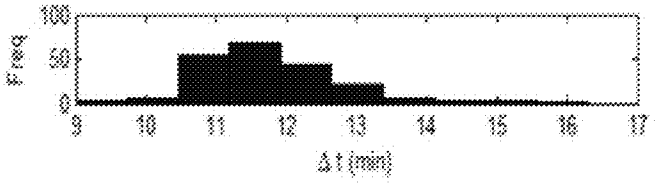
FIG. 4 is a graph highlighting some aspects of FIG. 3.

In part, FIG. 3 illustrates aspects of trajectory modeler variability that is based on actual, historical data. FIG. 4 shows that flight times from the meter fixes of FIG. 3 to the airport terminal vary between 9 and 16 minutes, wherein RNAV flights are narrowly centered in the middle of the distribution. This actual historical data indicates that RNAV flights vary relatively little, within a small window of time. Accordingly, it is seen that the variability of non-RNAV flights can be leveraged herein to space flights, while satisfying minimum spacing separations between specific aircraft. In some embodiments, known historical data for a navigational area of concern (e.g., a terminal airport) is used in making probabilistic predictions.

Figure 5:
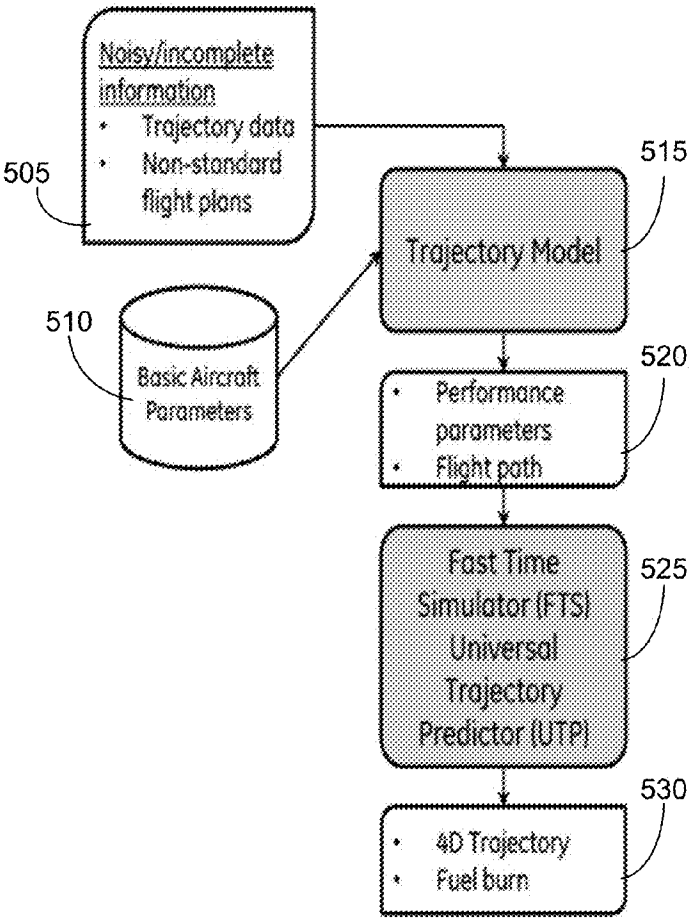
FIG. 5 is an illustrative flow diagram of a process, in accordance with one or more embodiments shown or described herein.

FIG. 5 is a flow diagram for a process 500 to generate unknown performance parameters, in some embodiments herein. At 505, certain input data is received and used in an effort to generate a trajectory for a number of flights. However, some of the data is noisy and/or incomplete. Yet, data 505 may be the best data available. Data 505 is sent to a trajectory modeler 515. Trajectory modeler 515 receives the incomplete data relating to the trajectory, non-standard flight plans, etc. Trajectory modeler 515, using data 510 and basic aircraft parameters for each aircraft, generates generic flight path and performance parameters 520. The flight path may include one trajectory for RNAV (i.e., PBN) flights and a trajectory with an upper and lower boundary for non-RNAV flights.

In some embodiments, the trajectory for RNAV (i.e., PBN) flights will be used by the Spacing Advisor 150 in determining the target spacing, where the trajectory is preserved as much as possible. The lower and upper boundaries for non-RNAV flights provide the potential ranges of modifications to the non-RNAV trajectory that may be applied through vectoring, so as to meet spacing or separation requirements.

Continuing to 525, specific flight information, including current position and other state information for specific aircraft is received from the on-board flight system(s) or a ground based monitoring or control system and used by the trajectory predictor to generate detailed trajectory information 530 (e.g., 4D, high resolution trajectory data) for each aircraft.

Figure 6:
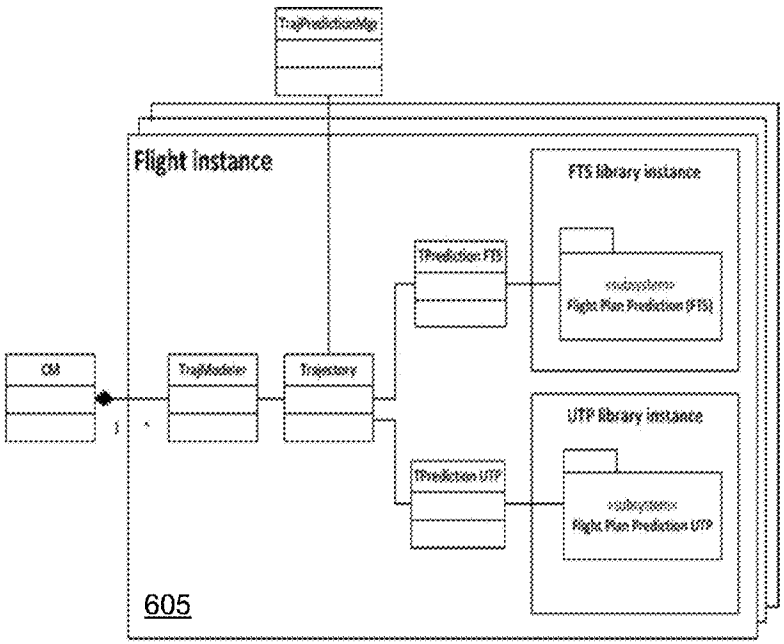
FIG. 6 is an illustrative representation of dynamic instantiations to model trajectories for multiple flights, in accordance with one or more embodiments shown or described herein.

In some embodiments herein, a system, device, platform, or service can execute a process to determine a probabilistic trajectory for each instance of a flight. For example, with reference to FIG. 6, a "flight instance" 605 is generated for each flight by each aircraft in a managed airspace. In some aspects, probabilistic trajectories for each flight instance can be executed independently of other trajectory determinations for other flight instances. In some instances, the different trajectory determinations for different flight instances can be executed in parallel, with the generated trajectories being persisted in a repository or otherwise maintained for reuse as new flights enter a simulation time window under consideration. In accordance with some aspects of FIG. 6, a self-contained trajectory modeler maintains a personality of each individual aircraft by, for example, using specific data relating to each aircraft. The specific data may include, for example, configuration properties, position, state, flight conditions and prediction parameters for a specific aircraft that can be persisted for the simulated flight's lifetime, as used to predict trajectories herein. In some aspects, since the flight instances for each aircraft's flight can be generated independently and maintained in a repository, a system, application, platform, or service can have knowledge of the other flights and use such information in determining current and future trajectories.

The processes disclosed herein, including but not limited to those executed by system 100 or process 300, may be implemented by a system, application, or apparatus configured to execute the operations of the process. In some embodiments, various hardware elements of an apparatus, device or system executes program instructions to implement a system (e.g., 100) and perform processes (e.g., 300 and 500). In some embodiments, hard-wired circuitry may be used in place of, or in combination with, program instructions for implementation of processes according to some embodiments. Program instructions that can be executed by a system, device, or apparatus to implement system 100 and process 300 (and other processes or portions thereof disclosed herein) may be stored on or otherwise embodied as non-transitory, tangible media. Embodiments are therefore not limited to any specific combination of hardware and software.

Figure 7:
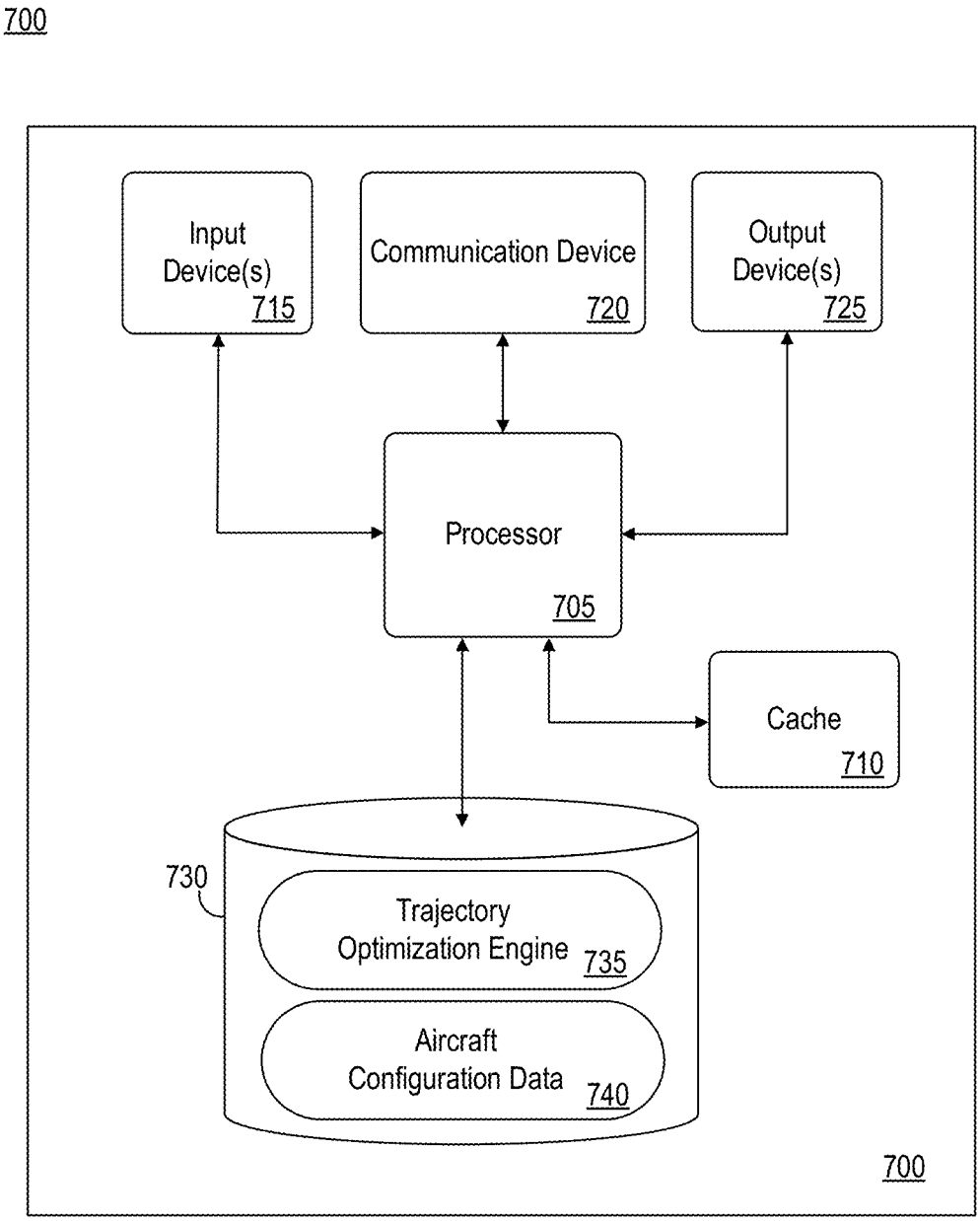
FIG. 7 is an illustrative depiction of a device, according to some embodiments herein.

FIG. 7 is a block diagram overview of a system or apparatus 700 according to some embodiments. System 700 may be, for example, associated with any of the devices described herein, including for example a FMS deployed in an aircraft, a ground-based system, and part of a service delivered via the "cloud". System 700 comprises a processor 705, such as one or more commercially available or custom-made Central Processing Units (CPUs) in the form of one-chip microprocessors or a multi-core processor, coupled to a communication device 720 configured to communicate via a communication network (not shown in FIG. 7) to another device or system. Communication device 720 may provide a mechanism for system 700 to interface with other local or remote applications, devices, systems, or services. System 700 may also include a cache 710, such as RAM memory modules. The system may further include an input device 715 (e.g., a touchscreen, mouse and/or keyboard to enter content) and an output device 725 (e.g., a touchscreen, a computer monitor to display, a LCD display).

Processor 705 communicates with a storage device 730. Storage device 730 may comprise any appropriate information storage device, including combinations of magnetic storage devices (e.g., a hard disk drive), optical storage devices, solid state drives, and/or semiconductor memory devices. In some embodiments, storage device 730 may comprise a database system, including in some configurations an in-memory database, a relational database, and other systems.

Storage device 730 may store program code or instructions 735 that may provide processor executable instructions for managing a trajectory optimization generator, in accordance with processes herein. Processor 705 may perform the instructions of the program instructions 735 to thereby operate in accordance with any of the embodiments described herein. Program instructions 735 may be stored in a compressed, uncompiled and/or encrypted format. Program instructions 735 may furthermore include other program elements, such as an operating system, a database management system, and/or device drivers used by the processor 705 to interface with, for example, peripheral devices (not shown in FIG. 7). Storage device 730 may also include data 740 such as aircraft configuration data disclosed in some embodiments herein. Data 740 may be used by system 700, in some aspects, in performing one or more of the processes herein, including individual processes, individual operations of those processes, and combinations of the individual processes and the individual process operations.

All systems and processes discussed herein may be embodied in program code stored on one or more tangible, non-transitory computer-readable media. Such media may include, for example, a floppy disk, a CD-ROM, a DVD-ROM, a Flash drive, magnetic tape, and solid state Random Access Memory (RAM) or Read Only Memory (ROM) storage units. Embodiments are therefore not limited to any specific combination of hardware and software.

The embodiments described herein are solely for the purpose of illustration. Those in the art will recognize other embodiments which may be practiced with modifications and alterations.

What is claimed is:

1. A method comprising:

receiving flight parameter data relating to a plurality of flights in a processor in communication with a storage device for storing executable instructions including a probabilistic spacing advisory tool (PSAT) with a trajectory modeler and a spacing advisor, the flight parameter data including indications of aircraft performance based navigation (PBN) capabilities, a cleared or best available flight plan information, an aircraft configuration, and an airport configuration for the plurality of flights;

assigning in the processor, probabilistic properties to the flight parameter data;

receiving, in the processor, accurate and current position and flight plan information for a plurality of aircraft corresponding to the flight parameter data;

determining, in the processor, a probabilistic trajectory for two of the plurality of aircraft based on a combination of the probabilistic properties of the flight parameter data and the position and predicted flight plan information in the trajectory modeler and the spacing advisor of the PSAT, the probabilistic trajectory being specific to the two aircraft and including a target spacing specification to maintain a predetermined spacing between the two aircraft at a target location with a specified probability; and generating, in the processor, a record of the probabilistic trajectory for the two aircraft.

2. The method of claim 1, wherein the flight parameter data further comprises at least one of aircraft equipage, flight crew qualifications regarding PBN procedures, aloft weather conditions, weather conditions at the target location, airport runway directions, airport runway instrument landing system status.

3. The method of claim 1, wherein the flight parameter data is received from an external source, an internal data store, models, and combinations thereof.

4. The method of claim 1, wherein the probabilistic trajectory for each of the two aircraft is determined based on the PBN capabilities of the aircraft being either PBN capable or non-PBN capable.

5. The method of claim 4, wherein the probabilistic trajectory for the two aircraft specifies target spacing between the two aircraft for which a trailing aircraft of the two aircraft is PBN capable and can be expected to execute a PBN approach without interruption to maintain, at the predetermined probability, the target spacing.

6. The method of claim 4, wherein the probabilistic trajectory for the two aircraft specifies target spacing between the two aircraft for which a trailing aircraft of the two aircraft is non-PBN capable and can be expected to execute a specified trajectory within a determined spacing tolerance at the predetermined probability.

7. The method of claim 1, wherein the probabilistic trajectory is determined for the two aircraft specifies, for each of the aircraft, at least one of their origin, destination, current state, aircraft type, flight time, latest flight plan, weather updates, and expected approach runway.

8. The method of claim 1, wherein the probabilistic trajectory is determined in real-time for currently active flights.

9. The method of claim 1, wherein the probabilistic trajectory is determined for at least one of a plurality of flight procedure combinations and a plurality of predetermined probabilities.

10. The method of claim 9, wherein the record comprises a spacing matrix including target spacing entries for the entries for the at least one plurality of flight procedure combinations and plurality of predetermined probabilities.

11. The method of claim 1, wherein the two aircraft are related pairs by being, for a period of time without limit to duration or when occurring, a navigation spacing concern to each other in a proximity of the target location.

12. A non-transitory computer-readable medium storing processor executable instructions, the medium comprising:

instructions to receive flight parameter data relating to a plurality of flights in a processor in communication with a storage device including a probabilistic spacing advisory tool (PSAT) with a trajectory modeler and a spacing advisor, the flight parameter data including indications of aircraft performance based navigation (PBN) capabilities, a cleared or best available flight plan information, an aircraft configuration, and an airport configuration for the plurality of flights;

instructions to assign probabilistic properties to the flight parameter data;

instructions to receive accurate and current position and flight plan information from on-board avionics or from a ground-based monitoring and control system for a plurality of aircraft corresponding to the flight parameter data;

instructions to determine a probabilistic trajectory for two of the plurality of aircraft based on a combination of the probabilistic properties of the flight parameter data and the position and predicted flight plan information, the probabilistic trajectory being specific to the two aircraft and including a target spacing specification to maintain a predetermined spacing between the two aircraft at a target location with a specified probability; and instructions to generate a record of the probabilistic trajectory for the two aircraft.

13. The medium of claim 12, wherein the flight parameter data further comprises at least one of aircraft equipage, flight crew qualifications regarding PBN procedures, aloft weather conditions, weather conditions at the target location, airport runway directions, airport runway instrument landing system status.

14. The medium of claim 12, wherein the probabilistic trajectory for each of the two aircraft is determined based on the PBN capabilities of the aircraft being either PBN capable or non-PBN capable.

15. The medium of claim 14, wherein the probabilistic trajectory for the two aircraft specifies target spacing between the two aircraft for which a trailing aircraft of the two aircraft is PBN capable and can be expected to execute a PBN approach without interruption to maintain, at the predetermined probability, the target spacing.

16. The medium of claim 14, wherein the probabilistic trajectory for the two aircraft specifies target spacing between the two aircraft for which a trailing aircraft of the two aircraft is non-PBN capable and can be expected to execute a specified trajectory within a determined spacing tolerance at the predetermined probability.

17. The medium of claim 12, wherein the probabilistic trajectory is determined for the two aircraft specifies, for each of the aircraft, at least one of their origin, destination, current state, aircraft type, flight time, latest flight plan, weather updates, and expected approach runway.

18. The medium of claim 12, wherein the probabilistic trajectory is determined in real-time for currently active flights.

19. The medium of claim 12, wherein the probabilistic trajectory is determined for at least one of a plurality of flight procedure combinations and a plurality of predetermined probabilities.

20. The medium of claim 12, wherein the record comprises a spacing matrix including target spacing entries for the entries for the at least one plurality of flight procedure combinations and plurality of predetermined probabilities.

* * * * *